US007391993B2

(12) United States Patent
Ito

(10) Patent No.: US 7,391,993 B2
(45) Date of Patent: Jun. 24, 2008

(54) IMAGE FORMING DEVICE WITH INTERLOCKED MECHANISM

(75) Inventor: Hiroshi Ito, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 11/258,221

(22) Filed: Oct. 26, 2005

(65) Prior Publication Data

US 2007/0092292 A1 Apr. 26, 2007

(51) Int. Cl.
*G03G 21/00* (2006.01)

(52) U.S. Cl. ..... 399/124; 399/125; 399/381; 399/388

(58) Field of Classification Search ..... 399/121, 399/122, 124, 125, 381, 388
See application file for complete search history.

(56) References Cited

U.S. PATENT DOCUMENTS 5,787,326 A * 7/1998 Ogawa et al. ..... 399/124
5,991,570 A * 11/1999 Haga et al. ..... 399/114

* cited by examiner

*Primary Examiner*—David M Gray
*Assistant Examiner*—Geoffrey T Evans
(74) *Attorney, Agent, or Firm*—Global IP Counselors, LLP

(57) ABSTRACT

A toner image formed on a photosensitive drum 12*a* in an image forming unit 12 is transferred to an intermediate transfer belt 11. The toner image of the intermediate transfer belt is transferred onto recording paper by a transfer roller 15, and a paper transport path 18 is defined by an image forming device main body and a lateral cover 20 turnably mounted on the image forming device main body 20. When in a protected position, a cover member 19 protects the intermediate transfer belt at a position corresponding to a nip between the intermediate transfer belt and a transfer unit, while when in a withdrawn position, the cover member 19 guides the recording paper. An interlocking mechanism, moving in response to the turning of the lateral cover, places the cover member at the protected position when the lateral cover is open, and places the cover member at the withdrawn position when the lateral cover is closed.

17 Claims, 10 Drawing Sheets

IMAGE FORMING DEVICE WITH INTERLOCKED MECHANISM

FIELD OF THE INVENTION

The present invention relates to an image forming device such as a copying machine, a printer, a fax device or the like, and more particularly to an image forming device comprising an intermediate transfer belt, wherein a toner image formed on the intermediate transfer belt is transferred onto recording paper.

BACKGROUND INFORMATION

In color image forming devices, image formation is generally carried out by forming color toner images by sequentially superposing toner images of each color on an intermediate transfer belt and then transferring the color toner image onto recording paper; in such image forming devices, the recording paper is transported from a paper feeding unit to a nip between the intermediate transfer belt and a secondary transfer roller, via a paper transport path, then after transfer of the color toner image to the recording paper, the latter is sent via the paper transport path to a fixing unit, and following color toner image fixation, the recording paper is output to a paper output tray via a paper output path.

In an image forming device where the paper output tray is disposed on the upper side of the chassis of the image forming device, and the paper feeding unit is arranged on the lower side of the chassis of the image forming device, the paper transport path takes a substantially vertical form; herein, a guide member is provided in the paper transport path for guiding the recording paper passing through a nip between the intermediate transfer belt and the secondary transfer roller towards the fixing unit.

When a paper jam occurs, the paper jam is handled by opening a lateral cover provided in the chassis of the image forming device to expose thereby the paper transport path (herein, since the secondary transfer roller is provided on the side of the lateral cover, the intermediate transfer belt (in particular, the nip thereof) becomes exposed when the lateral cover is opened). Thus, when the intermediate transfer belt is exposed for handling a paper jam, the user may inadvertently touch the intermediate transfer belt, which might result in faulty imaging.

There are also image forming devices where an openable/closable drum shutter is provided in the vicinity of the photosensitive drum, such that when the lateral cover is closed, the drum shutter is withdrawn, upstream in the paper transport direction from the photosensitive drum, and when the lateral cover is closed, the drum shutter is positioned opposite the photosensitive drum so as to cover the latter.

In conventional image forming devices, when the lateral cover is opened, the photosensitive drum, which is the image carrier, is protected by the drum shutter, while when the lateral cover is closed, the drum shutter is positioned further upstream in the paper transport direction than the photosensitive drum, the role of the drum shutter being to guide the recording paper being transported along the paper transport path in the nip between the photosensitive drum and the transfer roller; however, this is problematic in that an additional mechanism (member) must be provided for separating from the photosensitive drum the recording paper passing through the nip, which increases the number of parts and the like.

In conventional image forming devices, furthermore, the mechanism for moving the drum shutter in response to the opening /closing of the lateral cover is a complex one, and moreover, exposure of the intermediate transfer belt is not prevented when the lateral cover is opened.

In light of the above problems of the prior art, it is an object of the present invention to provide an image forming device having a simple constitution that allows for protecting an intermediate transfer belt when a lateral cover is opened, and that allows for easy separating of the recording paper passing through the nip between the intermediate transfer belt and a secondary transfer belt, when the lateral cover is closed.

SUMMARY OF THE INVENTION

In order to solve the above problems, the present invention is an image forming device provided with an image forming device main body having an image forming unit comprising a photosensitive drum, the image forming unit forming toner images on the photosensitive drum and an intermediate transfer belt onto which are transferred toner images of the photosensitive drum, and a transfer unit for transferring toner images of the intermediate transfer belt to recording paper, the image forming device having a cover body turnably mounted on the image forming device main body so that the image forming device main body and the cover body define a paper transport path along which the recording paper is transported to a nip between the intermediate transfer belt and the transfer unit, and along which the recording paper passing through the nip is transported to a fixing unit side; the image forming device comprising: a cover member for, when in a protected position, protecting the intermediate transfer belt at a position corresponding to the nip, and for, when in a withdrawn position, guiding the recording paper; and an interlocking mechanism moving in response to the turning of the cover body, for placing the cover member at the protected position upon the paper transport path becoming exposed when the cover body is open, and for placing the cover member at the withdrawn position when the cover body is closed.

In the present invention, the withdrawn position is located further downstream in the transport direction of the recording paper than the nip, and the interlocking mechanism has a supporting member, one end thereof being turnably supported on the image forming device main body, the other end being coupled to the cover member; an abutting portion provided in the cover member; and an arm provided in the cover body for, when the cover body is closed, abutting the abutting portion and turning the cover member, with one end of the supporting member as a support point, to place the cover member in the withdrawn position, wherein when the cover body is opened, the arm separates from the abutting portion, turning thereby the cover member, with one end of the supporting member as a support point, to place the cover member in the protected position. Also, the image forming unit is arranged for instance below the intermediate transfer belt.

In the present invention, thus, the cover member protects the intermediate transfer belt at a position corresponding to the nip when in a protected position, and when in a withdrawn position, the cover member guides the recording paper, while the interlocking mechanism, moving in response to the turning of the cover body, places the cover member at the protected position upon the paper transport path becoming exposed when the cover body (lateral cover) is opened, and places the cover member at the withdrawn position when the cover body is closed; as a result, the user is prevented from inadvertently touching the intermediate transfer belt when the cover body is opened to remove recording paper jammed in the paper transport path, since the intermediate transfer belt is protected by the cover member.

In the present invention, the withdrawn position is further downstream in the recording paper transport direction than the nip, one end of the supporting member is turnably supported on the image forming device main body, the other end being coupled to the cover member, an abutting portion is provided in the cover member, so that when the cover body is closed an arm provided in the cover body abuts the abutting portion and turns the cover member, with one end of the supporting member as a support point, to place the cover member in the withdrawn position, and when the cover body is opened, the arm separates from the abutting portion, and turns the cover member, with one end of the supporting member as a support point, to place the cover member in the protected position; the resulting effect of the foregoing, achieved with a simple constitution, is that of a combined guide member and protective member in a cover member that allows protecting the intermediate transfer belt when the cover body is opened, and that allows easily separating the recording paper passing through the nip between the intermediate transfer belt and a secondary transfer belt when the cover body is closed.

DETAILED DESCRIPTION OF THE PREFERRED EMBODIMENTS

Examples of preferred embodiments of the present invention are explained next in detail while making reference to accompanying drawings. Dimensions, materials, shapes, relative arrangements, etc. of the constituent elements recited in these embodiments are, unless distinctly specified, merely given as illustrative examples and are not meant in any way to limit the scope of the present invention.

Embodiment 1

Figure 1:
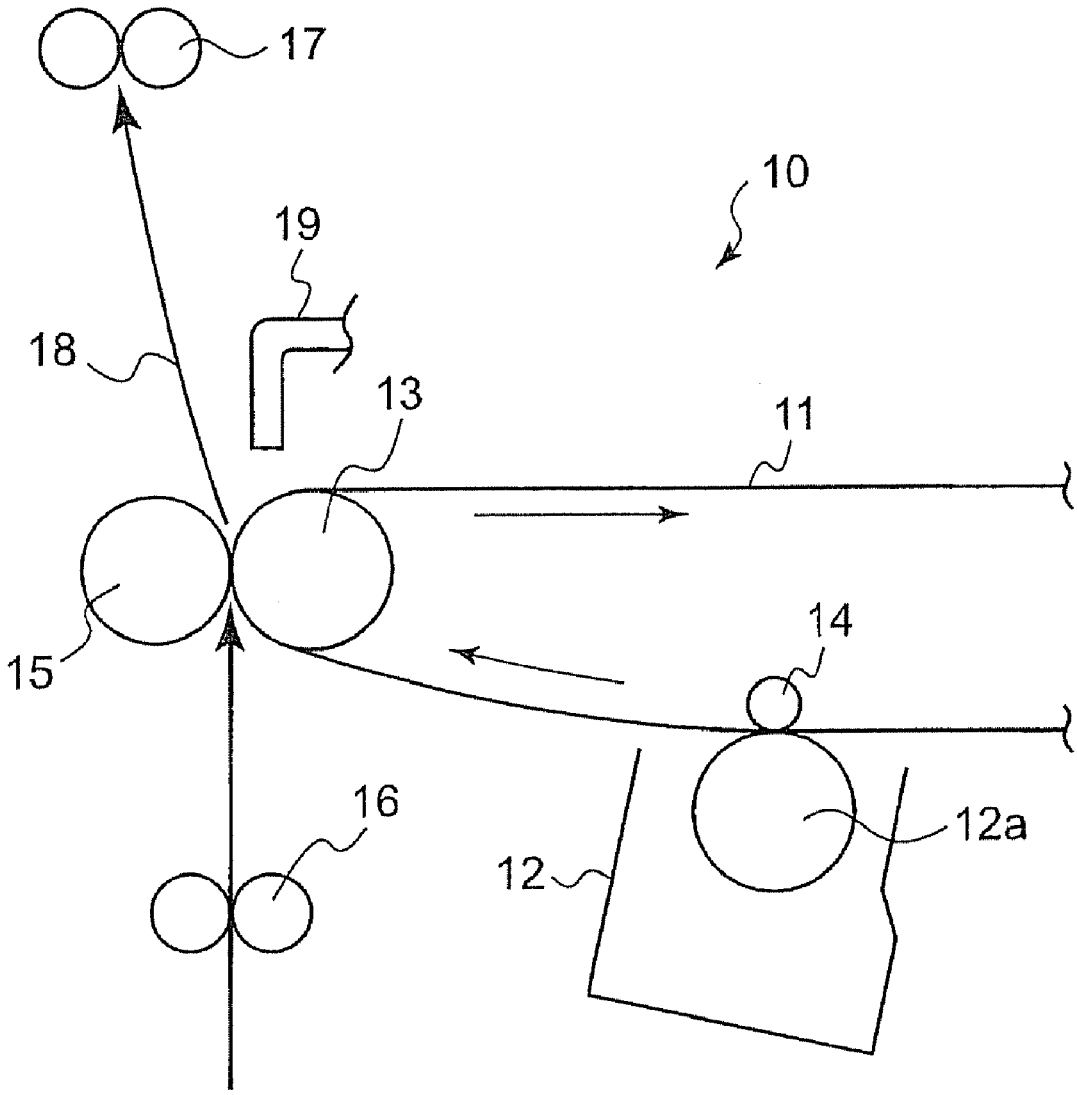
FIG. 1 is a view schematically illustrating a portion of an image forming device according to Embodiment 1 of the present invention.

FIG. 1 is a view illustrating schematically a portion of an image forming device according to the present invention; the image forming device 10 in the figure has an intermediate transfer belt 11, and image forming units 12 for each color arranged below and along the intermediate transfer belt 11 (only one image forming unit 12 is depicted in FIG. 1).

The intermediate transfer belt 11 is stretched tightly by a driving roller 13, a driven roller (not shown in the figure), and the like, and a photosensitive drum 12*a* of the image forming unit 12 is arranged opposite the primary transfer roller 14, flanking the intermediate transfer belt 11. A secondary transfer roller (transfer unit) 15 is arranged facing the driving roller 13; as shown in the figure, a substantially vertical paper transport path 18 is defined as transiting the registration rollers 16, the nip between the intermediate transfer belt 11 and the secondary transfer roller 15, and the fixing unit 17.

A toner image formed on the photosensitive drum 12*a* is transferred to the intermediate transfer belt 11 by the primary transfer roller 14. Transfer of each color toner image is carried out sequentially for each color to form thereby a color toner image on the intermediate transfer belt 11. The intermediate transfer belt 11 is rotated in the direction indicated by the solid arrow in the figure, then the color toner image is transferred to recording paper transported along the transport path 18, in the nip between the intermediate transfer belt 11 and the secondary transfer roller 15, after which the recording paper is sent to the fixing unit 17 where the color toner image is fixed on the recording paper.

As shown in the figure, a cover member 19 is provided at a position further downstream in the paper transport direction than the nip between the intermediate transfer belt 11 and the secondary transfer roller 15; as shown, the recording paper passing through the nip is separated from the intermediate transfer belt 11 by this cover member 19 (i.e. the recording paper is prevented from being drawn into the intermediate transfer belt side).

Figure 2:
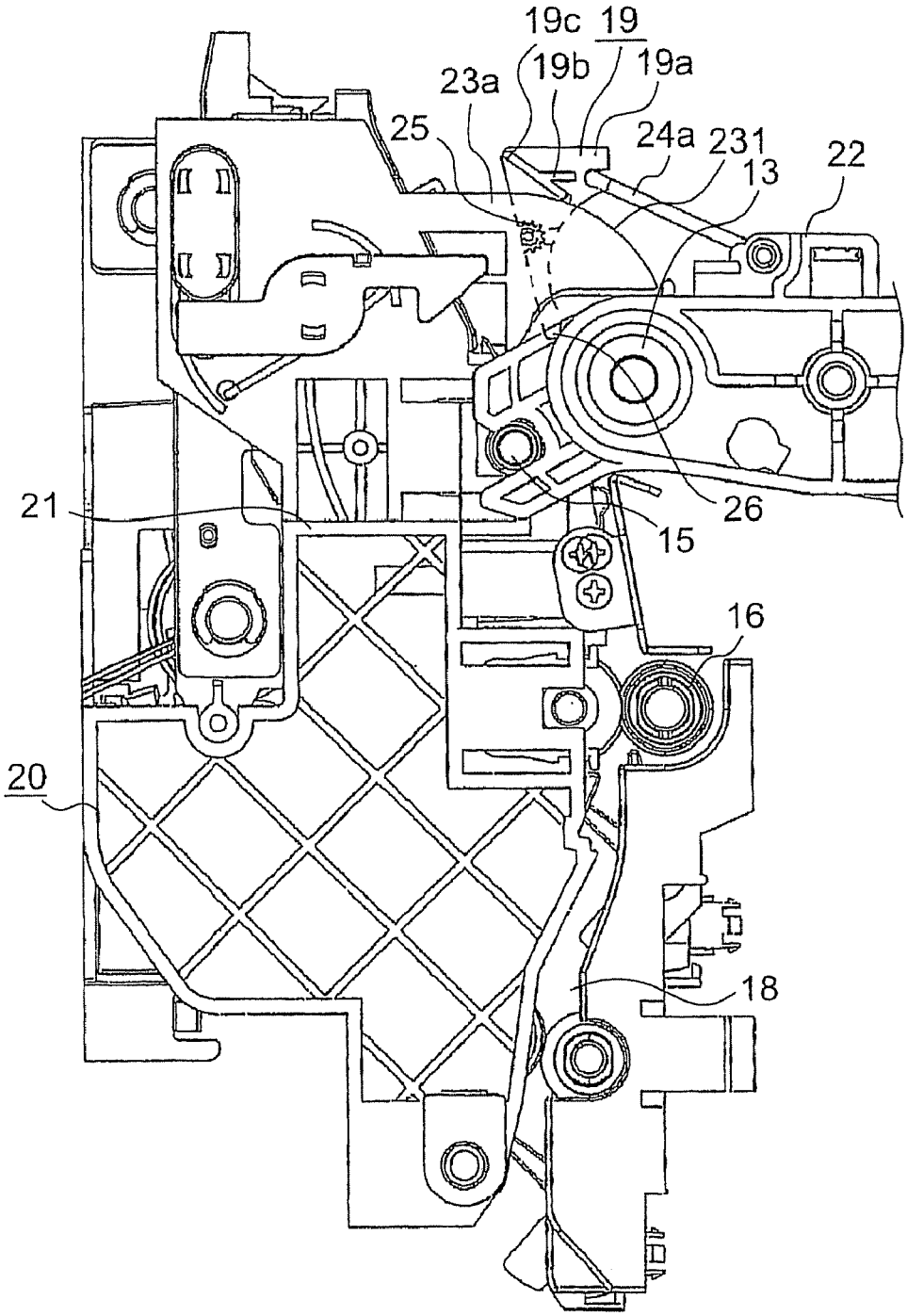
FIG. 2 is a cross-sectional diagram illustrating a lateral cover side of an image forming device according to Embodiment 1 of the present invention, with the lateral cover closed.
Figure 3:
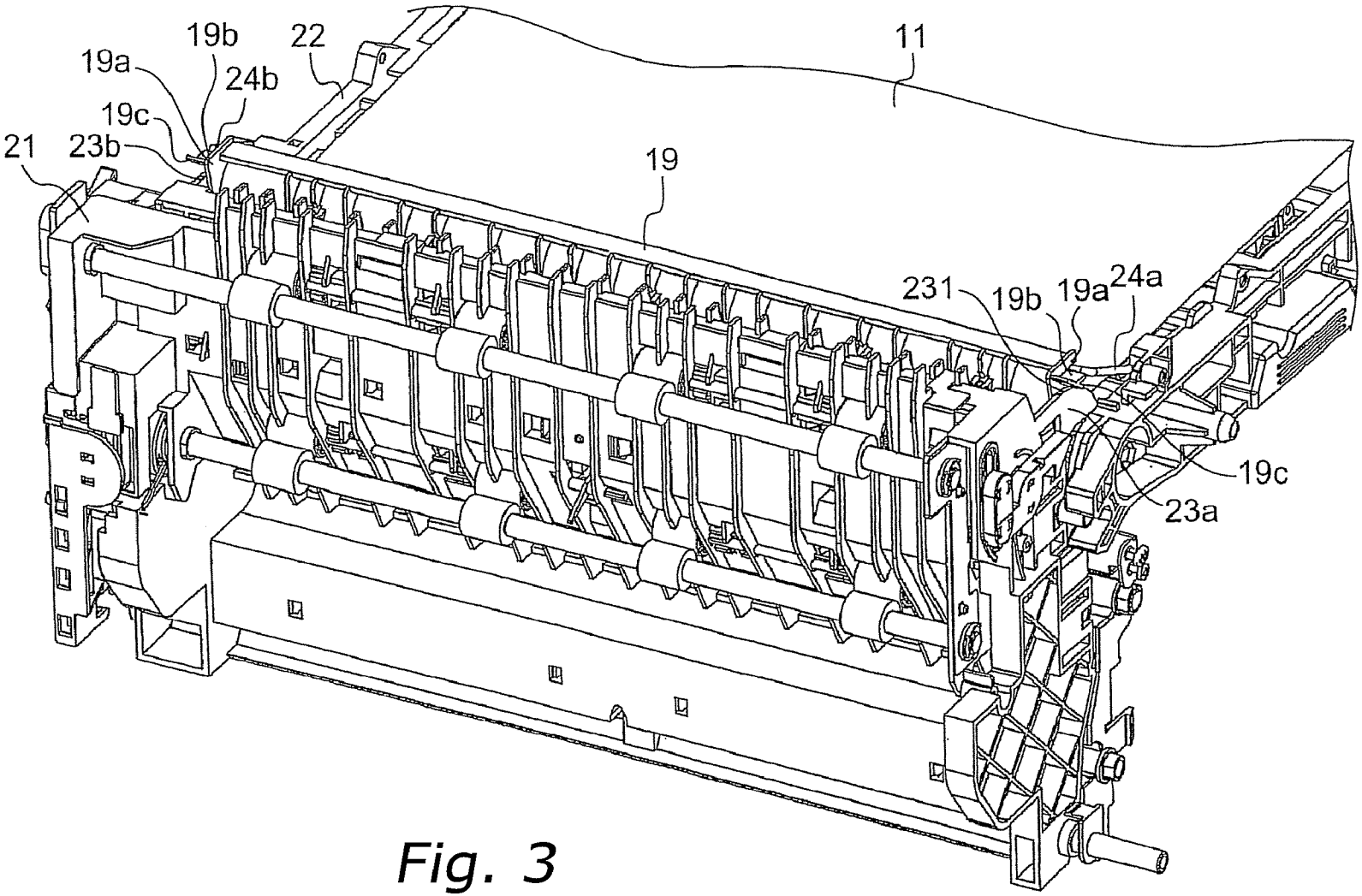
FIG. 3 is a perspective view diagram of FIG. 2.

With reference now to FIG. 2 and FIG. 3, FIG. 2 is a cross-sectional diagram illustrating the lateral cover side of an image forming device with the lateral cover closed, FIG. 3 being a perspective view thereof. A transport unit 21 is provided in a lateral cover (cover body) 20, so that the above-described paper transport path 18 is defined by the transport unit 21 (i.e. the lateral cover 20) and an image forming device main body 22. The transport unit 21 comprises a first registration roller 16 and a secondary transfer roller 15; when the lateral cover 20 is closed, the first registration roller 16 abuts a second registration roller 16 arranged on the side of the image forming device main body 22, and the secondary transfer roller 15 abuts the intermediate transfer belt 11.

The lower end of the lateral cover 20 is turnably supported on the image forming device main body 22 while arms 23*a* and 23*b* extending toward the image forming device main body 22 are formed at both ends of the transport unit 21. The cover member 19 extends substantially parallel to the paper transport path 18, and is provided with supporting shaft members (supporting members) 24*a* and 24*b* arranged at both ends of the image forming device main body 22, one end each of the supporting shaft members 24*a* and 24*b* rotatably supported on both ends, respectively, of the image forming device main body 22, the other end each of the supporting shaft members 24*a* and 24*b* turnably mounted, respectively, on both ends of the cover member 19.

Figure 4:
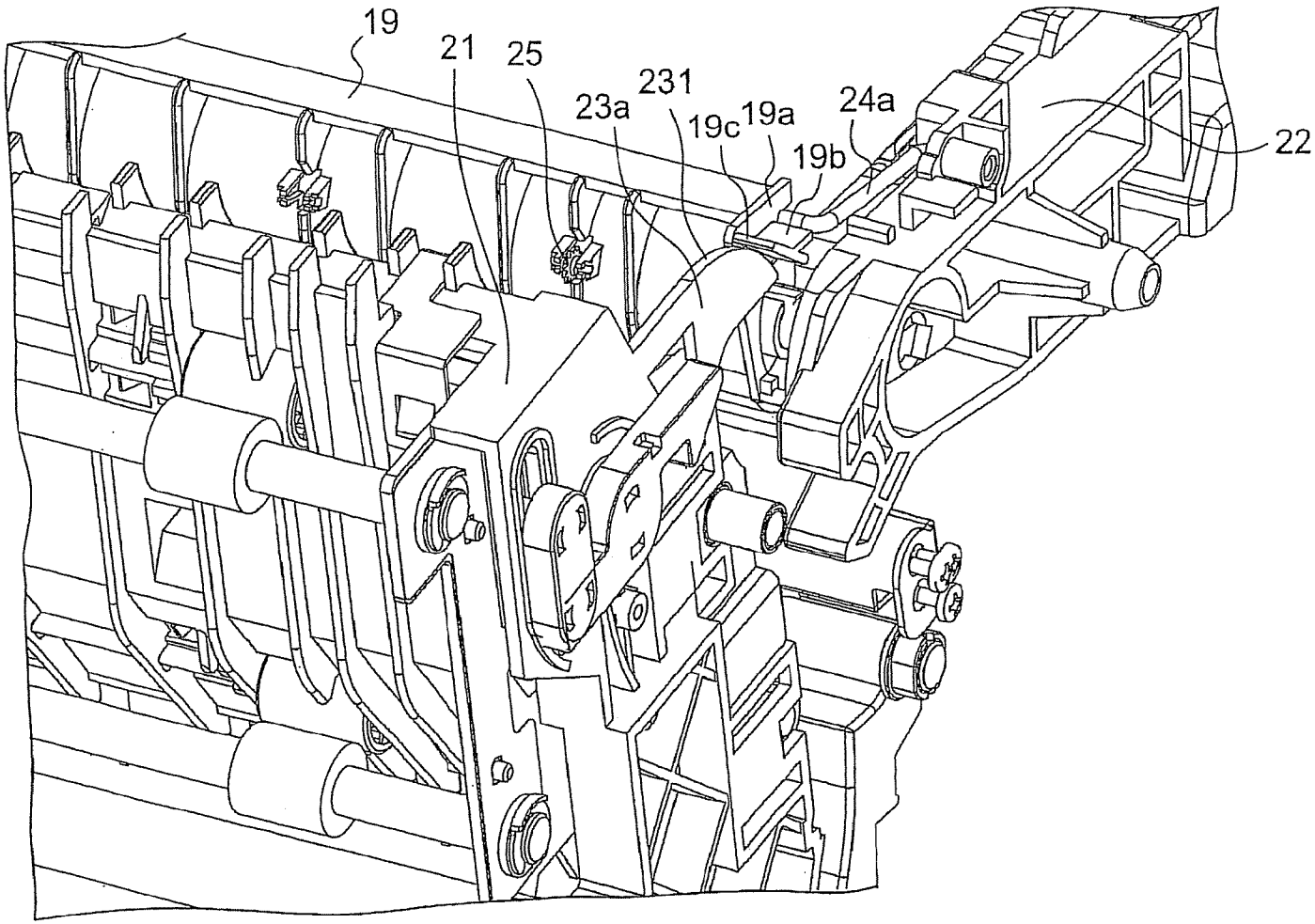
FIG. 4 is a perspective view diagram of an enlarged portion of FIG. 3.

With reference to FIG. 4, which shows an enlarged portion of FIG. 3, support pieces 19*b* are formed on both lateral walls 19*a* of the cover member 19, protruding in the longitudinal direction; and on these support pieces 19*b* are supported slant pieces (abutting portion) 19*c* slanting obliquely downwards, from the front of the paper in FIG. 4 towards the rear.

The upper pieces of the arms 23*a* and 23*b* are formed as arches (arcuate portions 231) inclined in the direction of the image forming device main body 22; herein, when the lateral cover 20 is closed, the arcuate portions 231 abut the lower surface side of the slant pieces 19*c* and are inserted in the side of the image forming device main body 22, whereby the cover member 19 is lifted with the supporting shaft members 24*a* and 24*b* as support points. The cover member 19 reaches thereby a withdrawn position.

Figure 5:
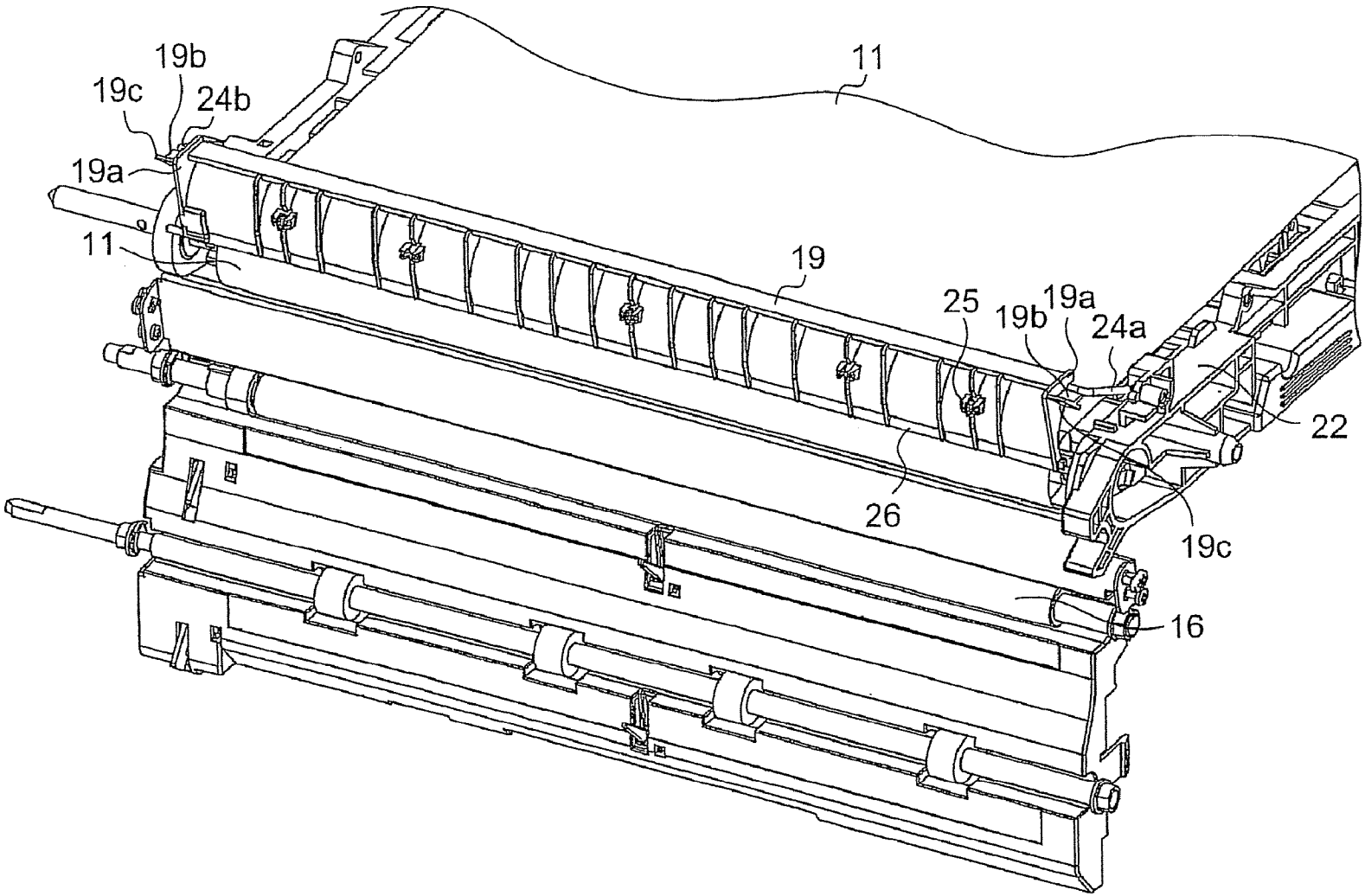
FIG. 5 is a perspective view diagram illustrating the situation in the image forming device according to Embodiment 1 of the present invention when a lateral cover is closed, the lateral cover being omitted in the figure.

FIG. 5 is a perspective view diagram illustrating the situation when the lateral cover 20 is closed, with the transport unit 21, i.e. the lateral cover 20, being omitted in the figure; on the surface of the cover member 19 (the face on the transport unit 21 side) are provided a plurality of roller members 25 in the longitudinal direction; the peripheral face of these roller members is formed as a wavy shape (these roller members are referred to hereinafter as toothed rollers). The lower end edge of the cover member 19 acts herein as a separation claw 26.

In the above withdrawn position, the cover member 19 is located at a position further downstream in the paper transport direction than the nip between the intermediate transfer belt 11 and the secondary transfer roller 15, while the separation claw 26 is positioned in the vicinity of the nip. As a result, the recording paper passing through the nip is separated by the separation claw 26, and is transported toward the fixing unit, guided by the toothed rollers 25. Herein, the peripheral face of the toothed rollers 25 touches the recording paper gently enough so as not to disturb the toner image on the recording paper.

Figure 6:
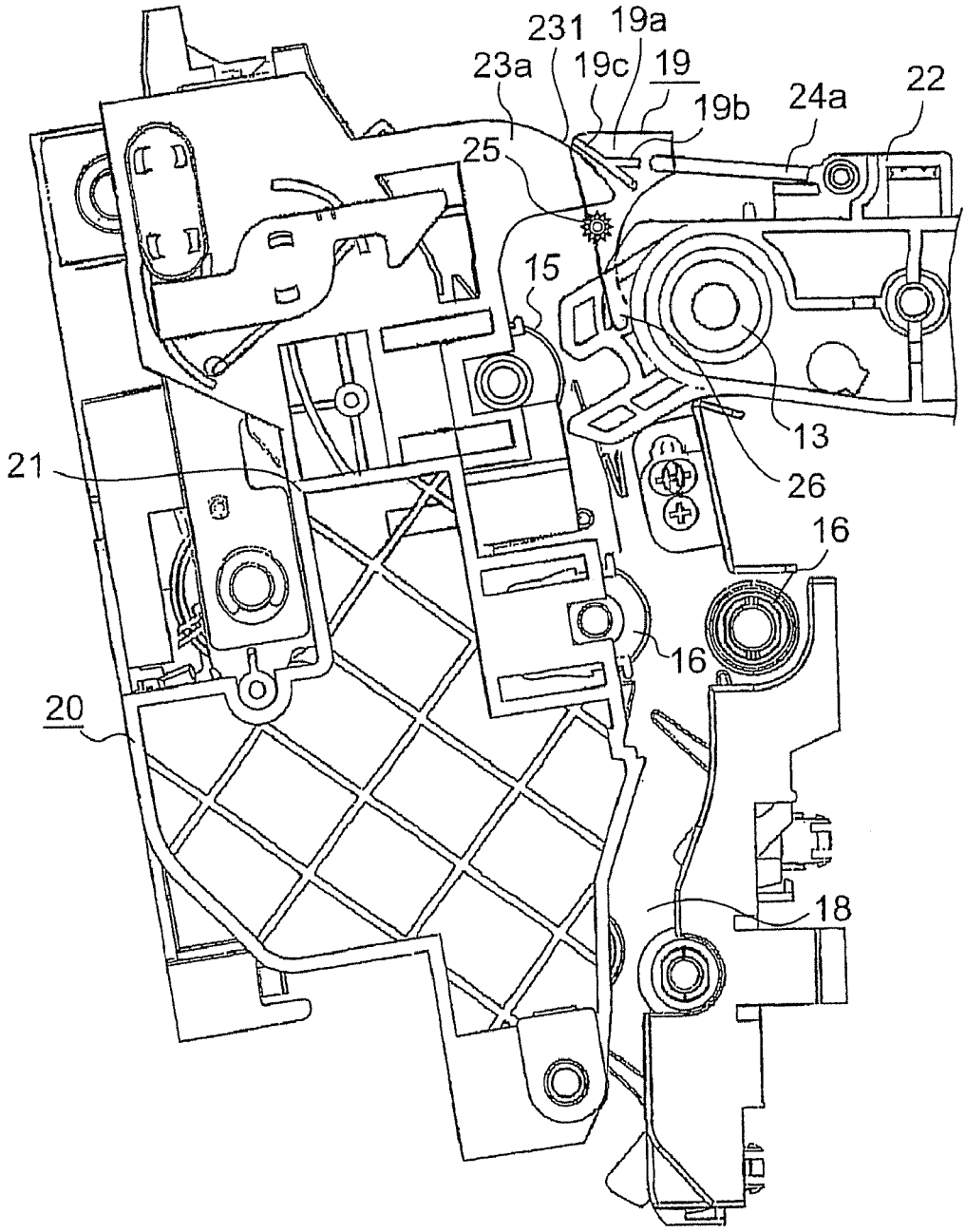
FIG. 6 is a cross-sectional diagram illustrating a lateral cover side of an image forming device according to Embodiment 1 of the present invention, with the lateral cover slightly opened.
Figure 7:
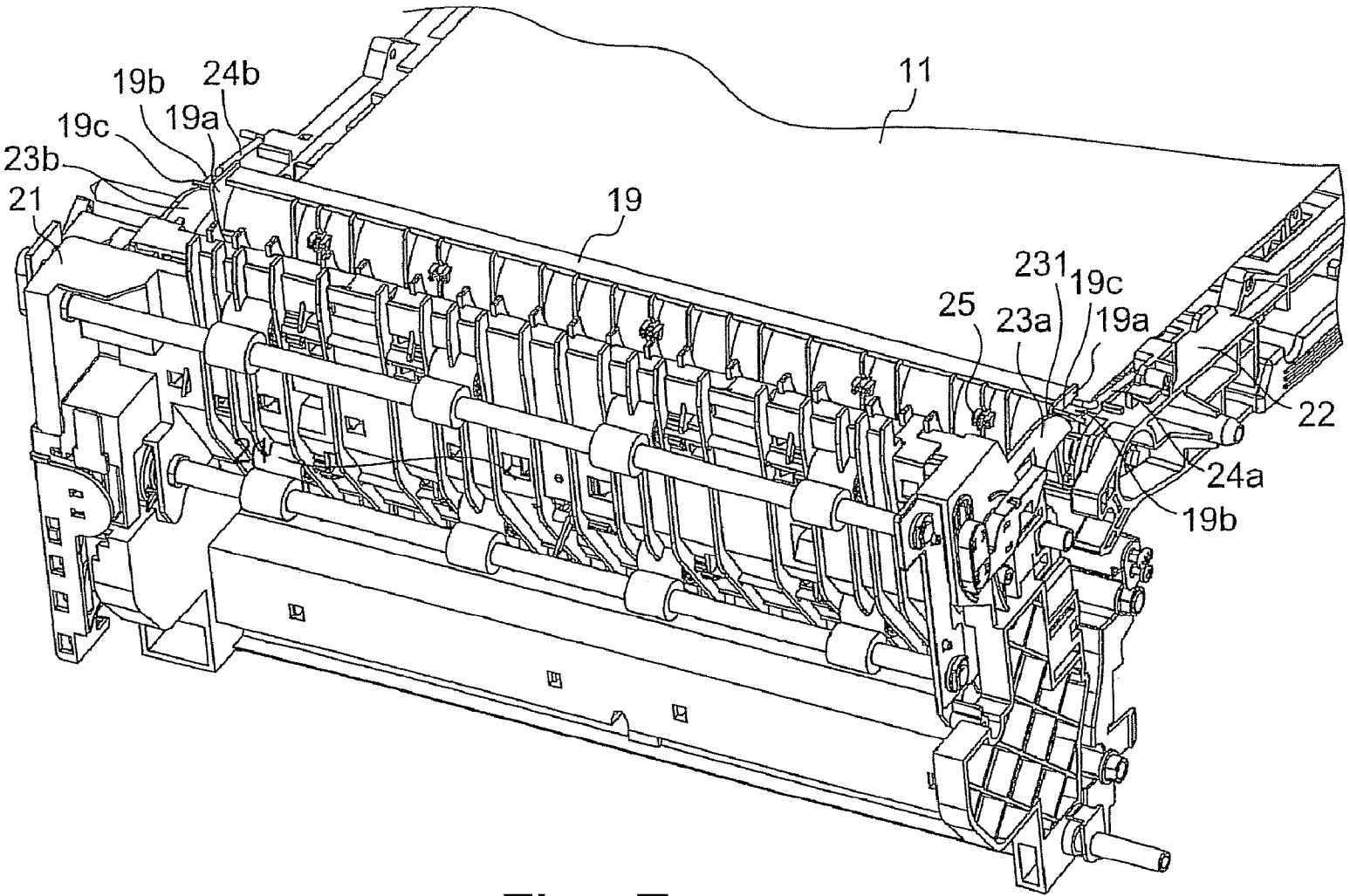
FIG. 7 is a perspective view diagram of FIG. 6.

With reference now to FIG. 6 and FIG. 7, FIG. 6 is a cross-sectional diagram illustrating the lateral cover side of an image forming device with the lateral cover slightly opened, FIG. 7 being a perspective view thereof. When the lateral cover 20 turns in the opening direction, the above-described arcuate portions 231 of the arms 23*a* and 23*b* abut the lower surface side of the slant pieces 19*c* and are pulled out of the side of the image forming device main body 22. As a result, the cover member 19 descends gradually in response to the turning of the lateral cover 20 in the opening direction, with the supporting shaft members 24*a* and 24*b* as support points.

Figure 8:
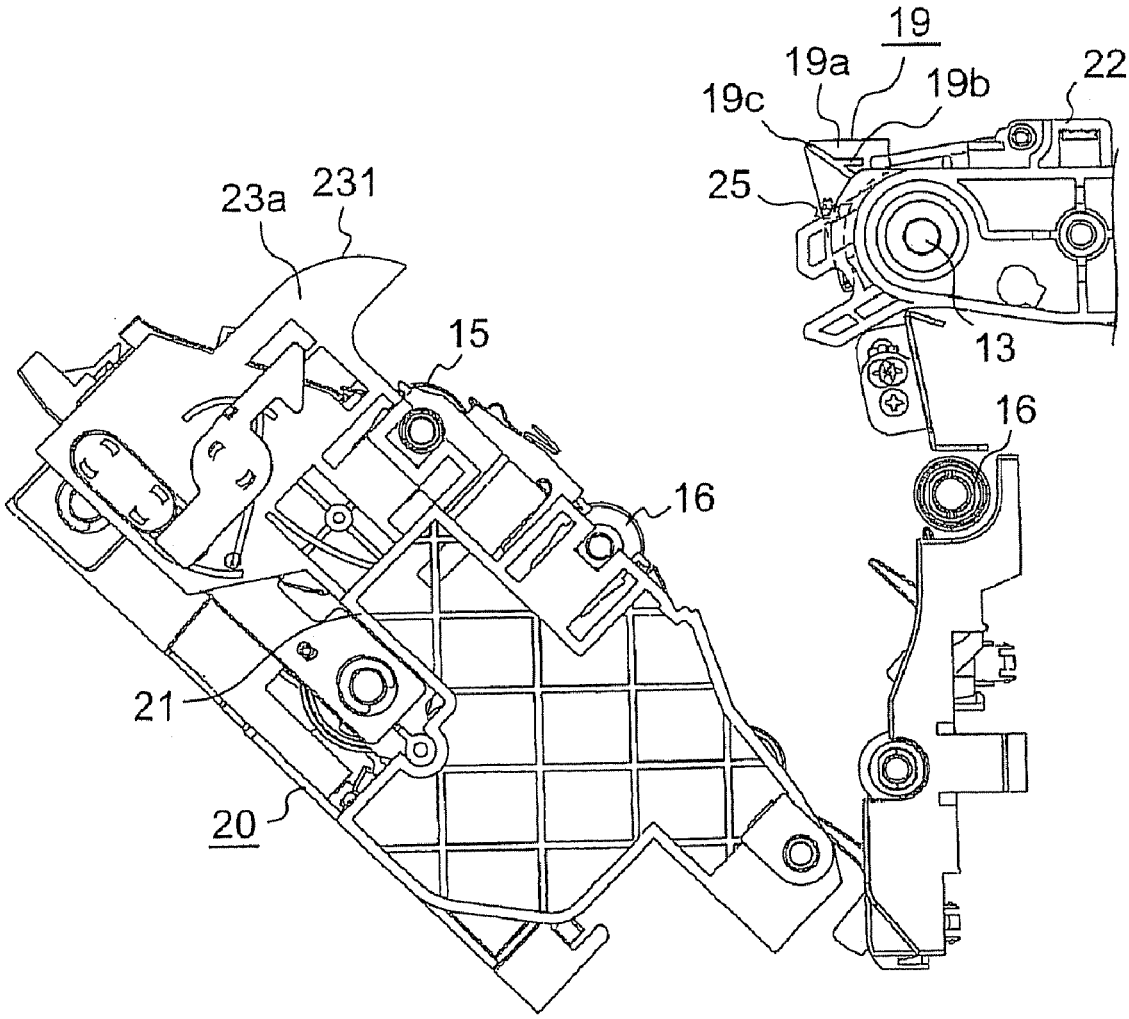
FIG. 8 is a cross-sectional diagram illustrating a lateral cover side of an image forming device according to Embodiment 1 of the present invention, with the lateral cover wholly opened.
Figure 9:
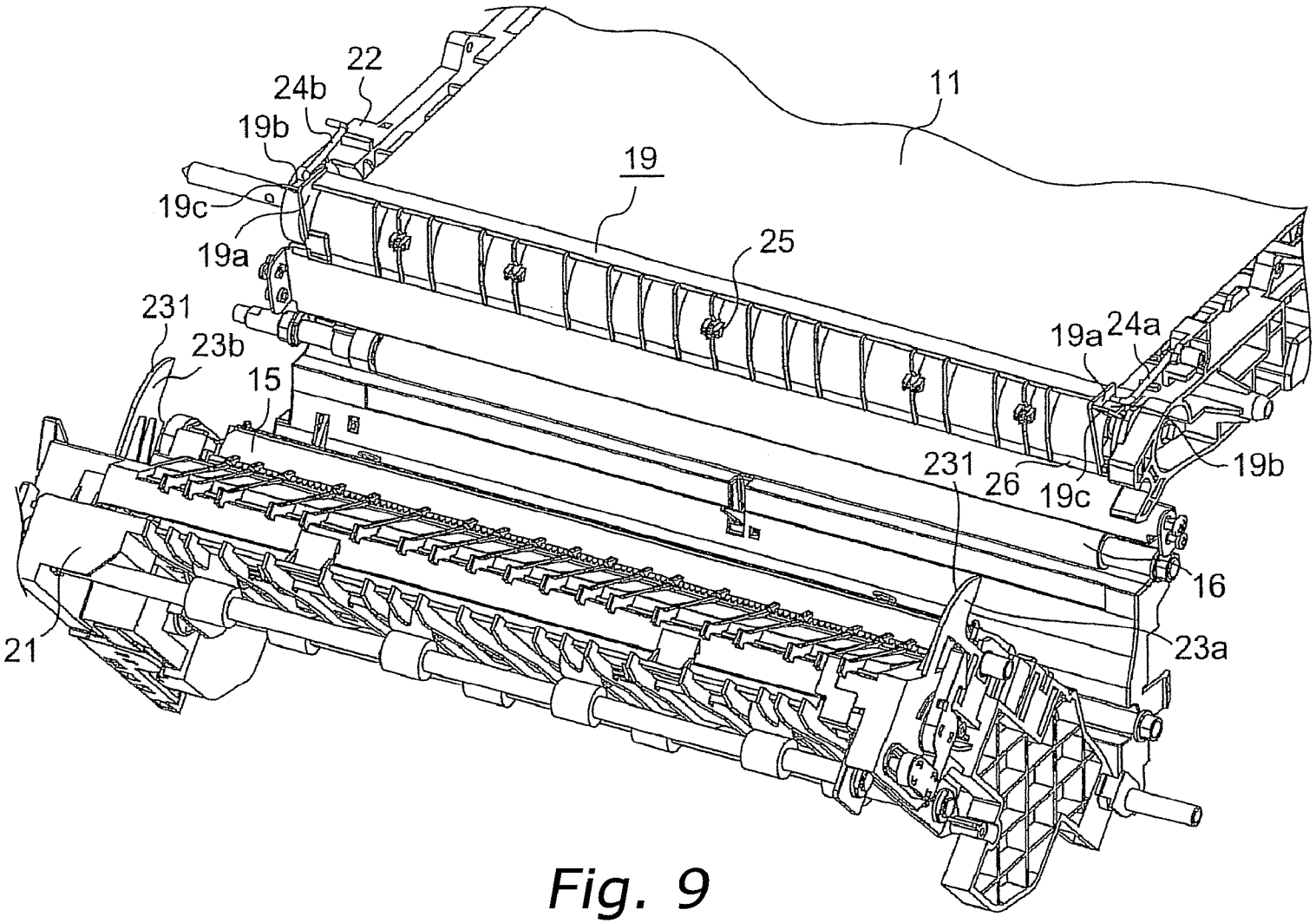
FIG. 9 is a perspective view diagram of FIG. 8.

With reference now to FIG. 8 and FIG. 9, FIG. 8 is a cross-sectional diagram illustrating the lateral cover side of an image forming device with the lateral cover completely opened, FIG. 9 being a perspective view thereof. When the lateral cover 20 turns in the opening direction and becomes wholly opened, the arcuate portions 231 of the arms 23*a* and 23*b* cease to abut the lower surface sides of the slant pieces 19*c*, which is to say they become completely separated from the lower surface side of the slant pieces 19*c*, whereby the cover member 19 attains a lowermost position (a position referred to hereinafter as the protected position), with the supporting shaft members 24*a* and 24*b* as support points.

In this protected position, the intermediate transfer belt 11 is covered by the cover member 19 at the position of the driving roller 13, and is prevented thereby from being exposed. That is, the user is prevented from inadvertently touching the intermediate transfer belt when the lateral cover 20 is opened to handle a paper jam caused by paper becoming jammed in the paper transport path 18, since, although the paper transport path 18 is exposed, the intermediate transfer belt 11 is covered by the cover member 19.

Figure 10:
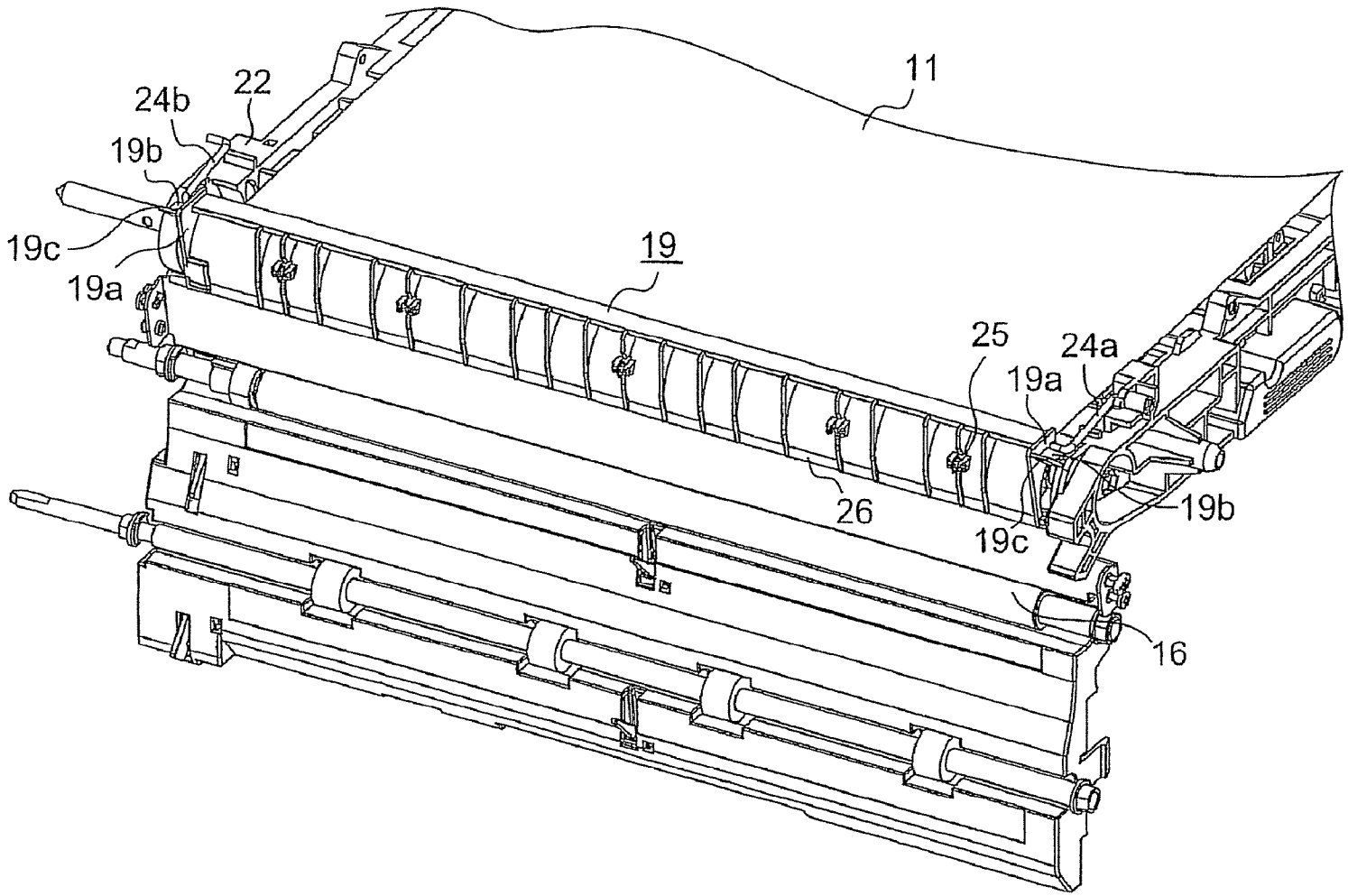
FIG. 10 is a perspective view diagram illustrating the situation in the image forming device according to Embodiment 1 of the present invention when a lateral cover is open, the lateral cover being omitted in the figure.

FIG. 10 is a perspective view diagram illustrating the situation when the lateral cover 20 is open, with the transport unit 21, i.e. the lateral cover 20, being omitted in the figure; in the state illustrated in FIG. 5, the cover member 19 is raised and the intermediate transfer belt 11 is exposed (i.e. abutting the secondary transfer roller 15), but when the lateral cover 20 is opened, the intermediate transfer belt 11 is covered by the cover member 19 and cannot be seen from the side.

When the lateral cover 20 is closed after being opened to handle a paper jam as described above, the arms 23*a* and 23*b* lift the cover member 19, as explained above, whereby the cover member 19 becomes positioned at a position further downstream in the paper transport direction than the nip between the intermediate transfer belt 11 and the secondary transfer roller 15.

As is evident from the foregoing explanation, the supporting shaft members 24*a* and 24*b*, the slant pieces 19*c*, and the arms 23*a* and 23*b* work collectively as an interlocked mechanism.

Thus, when the lateral cover is open, the intermediate transfer belt is protected by the cover member, while when the lateral cover is closed, the cover member is positioned at a position further downstream in the paper transport direction than the nip between the intermediate transfer belt and the secondary transfer roller, guiding thereby the recording paper passing through the nip; the resulting effect of the foregoing, achieved with a simple constitution, allows for easily separating the recording paper passing through the nip between the intermediate transfer belt and a secondary transfer belt while protecting the intermediate transfer belt.

What is claimed is:

1. An image forming device comprising:

an image forming device main body having an image forming unit comprising a photosensitive drum onto which are formed toner images and an intermediate transfer belt onto which are transferred toner images of the photosensitive drum;

a transfer unit for transferring toner images of the intermediate transfer belt to recording paper;

a fixing unit for fixing toner images transferred to the recording paper;

a cover body openably mounted to the image forming device main body so that the cover body and the image forming device main body define a transport path for transporting the recording paper to a nip between the intermediate transfer belt and the transfer unit and for transporting the recording paper passed through the nip to a fixing unit side; and a cover member turnably mounted to the image forming device main body downstream of the transfer unit in a transport direction, the cover member being configured to position both at a protected position for protecting the intermediate transfer belt at a position corresponding to the nip and at a withdrawn position for guiding the transfer of the recording paper, the cover member being provided with a plurality of rotatable roller members each having a portion protruding to a side abutting the transport path.

2. The image forming device according to claim 1, wherein the cover member has a function to separate the recording paper from the transfer unit.

3. The image forming device according to claim 2, wherein the cover member extends substantially parallel to the transport path in a direction of paper transport, a lower edge of the cover member is located adjacent to the nip and functions as a separation claw for separating the recording paper from the transfer unit.

4. The image forming device according to claim 1, wherein peripheral faces of the roller members have tooth shapes.

5. The image forming device according to claim 1, further comprising an interlocked mechanism to move the cover member in response to opening/closing of the cover body, the cover member positioned at the protected position when the cover body is open to prevent the transport path from being exposed and the cover body being positioned at the withdrawn position when the cover body is closed.

6. An image forming device comprising:

an image forming device main body having an image forming unit comprising a photosensitive drum onto which are formed toner images and an intermediate transfer belt onto which are transferred toner images of the photosensitive drum;

a transfer unit for transferring toner images of the intermediate transfer belt to recording paper;

a fixing unit for fixing toner images transferred to the recording paper;

a cover body openably mounted to the image forming device main body so that the cover body and the image forming device main body define a transport path for transporting the recording paper to a nip between the intermediate transfer belt and the transfer unit and for transporting the recording paper passed through the nip to a fixing unit side; and a cover member turnably mounted to the image forming device main body downstream of the transfer unit in a transport direction, the cover member being configured to position both at a protected position for protecting the intermediate transfer belt at a position corresponding to the nip and at a withdrawn position for separating the recording paper passed through the nip from the transfer unit, the cover member being provided with a plurality of rotatable roller members, a portion of which protruding to a side abutting the transport path.

7. The image forming device according to claim 6, wherein the cover member extends substantially parallel to the transport path in a direction of paper transport, an upstream end of a recording paper transport of the cover member is located adjacent to the nip and functions as a separation claw for separating the recording paper from the copy portion.

8. The image forming device according to claim 6, wherein peripheral faces of the roller members have tooth shapes.

9. The image forming device according to claim 6, further comprising an interlocked mechanism to move the cover member in response to opening/closing of the cover body, the cover member positioned at the protected position when the cover body is open and to prevent the paper transfer path from being exposed, and the cover body being positioned at the withdrawn position when the cover body is closed.

10. The image forming device comprising:

an image forming device main body having an image forming unit comprising a photosensitive drum onto which are formed toner images and an intermediate transfer belt onto which are transferred toner images of the photosensitive drum;

a transfer unit for transferring toner images of the intermediate transfer belt to recording paper;

a fixing unit for fixing toner images transferred to the recording paper;

a cover body openably mounted to the image forming device main body so that the cover body and the image forming device main body define a transport path for transporting the recording paper to a nip between the intermediate transfer belt and the transfer unit and for transporting the recording paper passed through the nip to a fixing unit side;

a cover member turnably mounted to the image forming device main body, the cover member being configured to position both at a protected position for protecting the intermediate transfer belt at a position corresponding to the nip and at a withdrawn position for guiding the transfer of the recording paper; and an interlocked mechanism to move the cover member in response to opening/closing of the cover body, the cover member being positioned at the protected position when the cover body is open and to prevent the paper transfer path from being exposed, and the cover member being positioned at the withdrawn position when the cover body is closed, the interlocked mechanism having at least one supporting member, at least one abutting portion provided in the cover member and at least one arm provided in the cover body and protruding to an image forming device main body side, the arm abutting the abutting portion to turn the cover member and place the cover member at the withdrawn position when the cover body is closed, and the arm separating from the abutting portion to turn the cover member with one end of the supporting member as a supporting point and place the cover member at the protected position when the cover body is opened.

11. The image forming device according to claim 10, wherein at least part of the cover member extends in a direction perpendicular to the direction of transfer of the recording paper.

12. The image forming device according to claim 11, wherein the interlocked mechanism has a pair of the supporting members with one end being turnably supported on the image forming device main body, and another end being coupled to a longitudinal end of the cover member.

13. The image forming device according to claim 11, wherein the abutting portion is provided on both lateral walls of the cover member so as to extend further outward in a longitudinal direction of the both lateral walls.

14. The image forming device according to claim 13, wherein the abutting portions have a slant face such that one side separated from a turning supporting point of the cover member is placed at a more upper position than another side adjacent to the turning supporting point.

15. The image forming device according to claim 14, wherein a portion of the arm abutting the slant face has an arc shape.

16. The image forming device according to claim 10, wherein the cover member is disposed further downstream in the direction of the recording paper than the nip in the withdrawn position.

17. The image forming device according to claim 10, wherein the image forming unit is disposed below and along the intermediate transfer belt.

* * * * *